US008266876B1

(12) United States Patent
Thuesen et al.

(10) Patent No.: US 8,266,876 B1
(45) **Date of Patent: *Sep. 18, 2012**

(54) MATCHBOOKS HAVING ADVERTISING MEDIA

(75) Inventors: Marcus L. Thuesen, Houston, TX (US); Lejo C. Brana, Houston, TX (US)

(73) Assignee: AdverFlame, LLC

( * ) Notice: Subject to any disclaimer, the term of this patent is extended or adjusted under 35 U.S.C. 154(b) by 0 days.

This patent is subject to a terminal disclaimer.

(21) Appl. No.: 13/373,159

(22) Filed: Nov. 7, 2011

Related U.S. Application Data

(60) Division of application No. 11/893,252, filed on Aug. 15, 2007, which is a continuation of application No. 10/980,547, filed on Nov. 3, 2004, now abandoned.

(51) Int. Cl.
*B65B 61/20* (2006.01)

(52) U.S. Cl. ..... 53/445; 206/103; 206/831

(58) Field of Classification Search ..... 206/103, 206/459.1, 98, 100, 102, 104, 113, 232, 223, 206/831, 99, 118, 119, 459.5; 53/445
See application file for complete search history.

(56) References Cited

U.S. PATENT DOCUMENTS

| | | | | | |
|---|---|---|---|---|---|
| 1,116,043 | A | | 11/1914 | Elliot | |
| 1,634,712 | A | | 7/1927 | Friedman | 206/103 |
| 1,646,229 | A | * | 10/1927 | Alter | 206/104 |
| 1,650,703 | A | | 11/1927 | Friedman | 206/103 |
| 1,829,994 | A | * | 11/1931 | Langley | 53/395 |
| 1,839,846 | A | | 1/1932 | Greenbaum | 206/103 |
| 1,968,353 | A | | 7/1934 | Potter | 206/103 |
| 1,975,526 | A | | 10/1934 | Williams et al. | 206/103 |
| 2,105,842 | A | | 1/1938 | Pindell | 206/103 |
| 2,118,634 | A | | 5/1938 | Williams | 206/104 |
| 2,184,629 | A | | 12/1939 | Weiss | 206/103 |
| 2,234,276 | A | | 3/1941 | Redcliffe | 206/103 |
| 2,288,342 | A | | 6/1942 | Brooks | 206/29 |
| 2,411,368 | A | | 11/1946 | Dow | 206/29 |
| 2,933,181 | A | | 4/1960 | Will | 206/29 |
| 2,996,173 | A | | 8/1961 | Will | 206/103 |
| 3,038,595 | A | * | 6/1962 | Janus | 206/103 |
| 3,211,470 | A | | 10/1965 | Wilson | 283/85 |

(Continued)

OTHER PUBLICATIONS

Km Zundholz Int'L Karl Muller GmbH Website (www.kmmatch.com) , page http://www.kmmatch.com/Werbezuendhoelzer/pic/abbildung/g_specia12.jpg (Aug. 11, 2004).

(Continued)

*Primary Examiner* — Jacob K Ackun
*Assistant Examiner* — Jenine Pagan
(74) *Attorney, Agent, or Firm* — Keith B. Willhelm

(57) ABSTRACT

Improved matchbooks having separable message sheets are provided for. The novel matchbooks each comprise a comb of matches having a plurality of matches and a cover. The cover is attached to and folded over the comb such that the cover substantially encloses the comb when the cover is in a first closed position and permits a consumer to access the matches in the comb when the cover is in a second open position. The cover has igniting material on the cover on which the matches may be struck and ignited. The matchbooks also have a message sheet providing a substrate on which a message may be imprinted. The message sheet is separably connected to the cover such that the message sheet is separable from the cover. Thus, the message sheet may be removed from a novel matchbook by a consumer without compromising the integrity of the matchbook.

29 Claims, 9 Drawing Sheets

U.S. PATENT DOCUMENTS

| | | | | |
|---|---|---|---|---|
| 3,358,817 | A | 12/1967 | Will | 206/29 |
| 3,394,795 | A | 7/1968 | Bernard | 206/103 |
| 3,958,689 | A | 5/1976 | Roth | 206/104 |
| 4,103,820 | A | 8/1978 | Mathison et al. | 206/831 |
| 4,154,337 | A | 5/1979 | Tybie | 206/118 |
| 4,620,664 | A | 11/1986 | Kaufman | 229/17 |
| 4,690,273 | A | 9/1987 | Smith | 206/105 |
| 4,795,027 | A | 1/1989 | Benavides | 206/106 |
| 4,917,236 | A | 4/1990 | Galvez-Moran | 206/102 |
| 5,072,877 | A | 12/1991 | Van Fulpen | 229/155 |
| 5,074,462 | A | 12/1991 | Countee, Jr. | 229/155 |
| 5,119,941 | A | 6/1992 | Lepie | 206/102 |
| 5,474,183 | A | 12/1995 | Warren et al. | 206/459.5 |
| 6,085,903 | A | 7/2000 | Jotcham et al. | 206/459.5 |
| 6,305,531 | B1 | 10/2001 | Wilkman | 206/459.5 |
| 2002/0030112 | A1 | 3/2002 | Schreiber | 235/494 |
| 2006/0157370 | A1 | 7/2006 | Thuesen et al. | 206/459.5 |

OTHER PUBLICATIONS

Office Action, U.S. Appl. No. 10/980,547, mailed Aug. 8, 2006.
Office Action, U.S. Appl. No. 10/980,547, mailed Jan. 17, 2007.
Office Action, U.S. Appl. No. 10/980,547, mailed Apr. 16, 2007.
Office Action, U.S. Appl. No. 10/980,547, mailed Dec. 11, 2007.
Office Action, U.S. Appl. No. 11/893,252, mailed Jan. 27, 2009.
Office Action, U.S. Appl. No. 11/893,252, mailed Jun. 30, 2009.
Office Action, U.S. Appl. No. 11/893,252, mailed Mar. 30, 2011.

* cited by examiner

FIG. 8
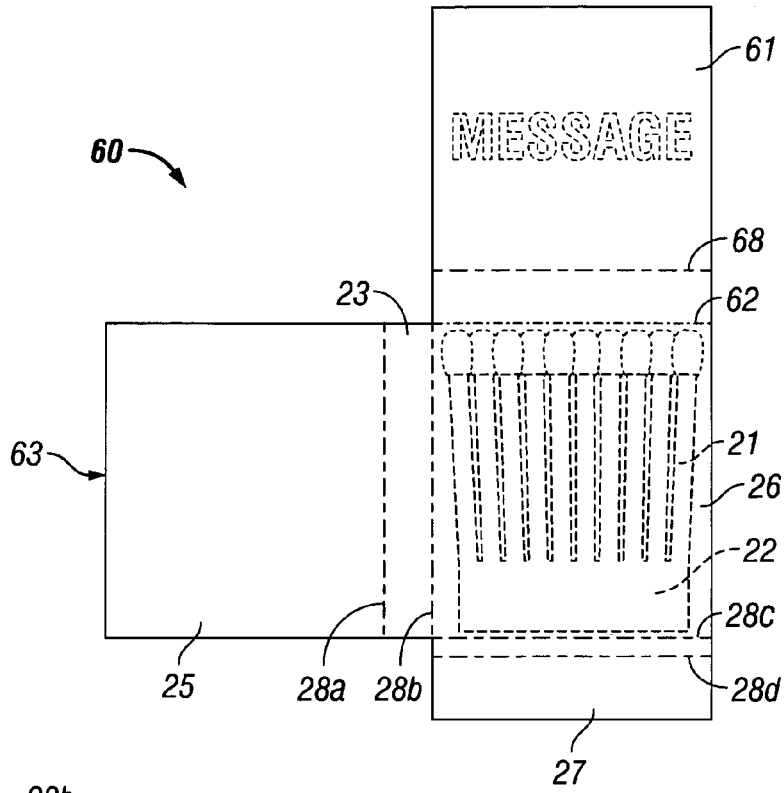
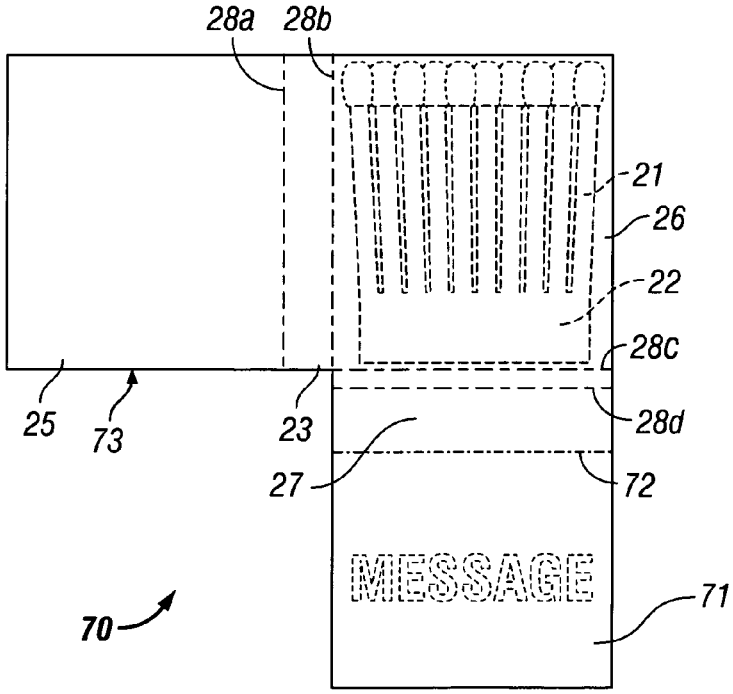
FIG. 9

MATCHBOOKS HAVING ADVERTISING MEDIA

CLAIM TO PRIORITY

This application is a divisional of an application of Marcus L. Thuesen and Lejo C. Brana, entitled "Matchbooks Having Advertising Media", U.S. Ser. No. 11/893,252, filed Aug. 15, 2007, which is a continuation of an application of Marcus L. Thuesen and Lejo C. Brana, entitled "Matchbooks Having Advertising Media", U.S. Ser. No. 10/980,547, filed Nov. 3, 2004, now abandoned.

FIELD OF THE INVENTION

The present invention relates to matchbooks, and more particularly, to improved matchbooks having separable advertising media and to methods for disseminating advertising messages, especially manufacturer coupons, to consumers via such improved matchbooks.

BACKGROUND OF THE INVENTION

Advertisers have relied on many different ways to deliver advertising messages. For example, many advertisements are delivered through broadcast mass media, such as radio and television, or through printed mass media, such as magazines and newspapers. Direct advertising is another popular and often highly effective method because messages are delivered directly to a defined population of consumers. In addition to direct mail and e-mails, other direct advertising methods include dimensional mail, catalogs, and inserts in bills and other mailings.

Despite the many different media available to advertisers, however, there is a continuing need to develop effective, cost efficient methods of advertising. For example, while distribution by broadcast media is relatively inexpensive, the cost of producing entertainment, news and other content to attract an audience for broadcast media can be extremely expensive, and those costs are reflected in advertising fees. Content production costs for printed mass media also can be substantial, and printed mass media can be expensive to produce and distribute. While most direct advertising contains little or no content beyond the advertising message, and thus, involves relatively low content cost, the cost of direct advertising nevertheless can be substantial. Such costs typically include the generation of a mailing list and postage or other delivery costs.

Moreover, a substantial portion, if not the majority of all advertising messages are never viewed by their intended audience for one reason or another. Many consumers receiving the advertisement may have no interest in the advertised good or service, or they may not be able to afford it. There also is a general clutter of advertisements that makes it difficult for a particular ad to capture the attention of consumers, especially if the consumer is distracted or otherwise occupied when the opportunity for viewing the ad arises.

For example, response rates for radio and television advertising typically is under 1%. Although inserts in newspapers and magazines commonly have somewhat higher response rates, on the order of 1-2%, newspaper and magazine advertisements also have very low response rates, usually under 1%. Direct mail, catalogs, and e-mails have average response rates around 2%. The response rates for all of these methods, however, are greatly reduced because the vast majority of the ads are never viewed. For example, most direct mailings are thrown away without ever being opened. Likewise, from 85% to 99% of e-mailings are never opened. Even when presented to a consumer, however, many ads are not really viewed because they are lost in the clutter of many other ads, and this is a common problem with newspaper inserts and some forms of direct mailings.

Thus, most advertising methods are very inefficient and wasteful. The effective cost for each advertising message that is actually communicated to consumers is generally many times higher that the nominal cost per message. Thus, despite, and in part because of the number and variety of conventional methods, advertisers continue to seek more cost effective ways of disseminating advertising messages. In particular, there is a continuing need for more effective and more economical methods for distributing manufacturer coupons.

Many products, such as food and consumer household products, are promoted extensively using manufacturer coupons. Such coupons typically offer a discount on specifically identified products. Consumers may redeem the coupons with merchants selling the product. The merchants in turn are reimbursed by the manufacturer or distributor of the product. The vast majority of manufacturer coupons are redeemed by merchants through a clearing house such as NCH Marketing Services, Deerfield, Ill. The automated processing of such manufacturer coupons essentially requires that they incorporate machine readable indicia, such as UPC bar codes utilizing the UCC/EAN-128 Article Numbering System. Information on standards for manufacturer coupons is publicly available, for example, through Uniform Code Council, Inc., Lawrenceville, N.J., and through Grocery Manufacturers of America, Inc., Washington, D.C.

Manufacturer coupons have been distributed by various methods, including newspaper and other print media inserts, direct mailings, and e-mailings. They also have been distributed as part of "cross ruffing" or "bounce back" offers. Such offers attach or include a coupon for a product in packaging for that product or another product, and many products can be easily adapted for use in carrying coupons. For example, cereal and other food products that are distributed in relatively large packages can easily accommodate manufacturer coupons. Many products, however, have relatively little imprintable area available for a bar code and even minimal product identification as is required to produce a consumer redeemable, manufacturer coupon.

Matchbooks, for example, have long been used to disseminate advertising messages. Very commonly, a sponsor's advertising message is imprinted on the cover of matchbooks, and then the matchbooks are distributed free of charge by or on behalf of the sponsor. While the covers of conventional matchbooks usually have sufficient imprintable area on which a coupon may be provided, they nevertheless are poorly suited for such purposes. The outer face of the cover is usually reserved for the sponsor's branding message. Theoretically, a coupon could be imprinted on the inner face of the cover, but as a practical matter the matches would have to be removed from the cover in order to redeem and process the coupon. If the coupon, i.e., the cover is detached immediately by a consumer it will impair the functionality of the matchbook. On the other hand, considerable time may elapse before the matches are consumed and functionality is no longer an issue, during which time the consumer may loose the matchbook or his enthusiasm for redeeming the coupon, or the coupon may become damaged or soiled. There also is a perception that the matchbook is trash once all the matches have been used, and this too could reduce the rate of redemption if coupons were printed on matchbook covers.

U.S. Pat. No. 3,958,689 to E. Roth discloses matchbooks having an insert. The insert is connected to a base, and the base is stapled within the matchbook between a match comb and the rear panel of a cover. The insert may be detached from the base by tearing along a line of perforations and then removed from the matchbook. The patent suggests that the insert may be imprinted with suitable markings that may be filled in by a consumer to order goods or the like advertised on the matchbook. The matchbooks disclosed in the Roth '689 patent have even greater imprintable area available for advertising messages, although the manufacture of such matchbooks, as compared to conventional matchbook designs, is complicated by the fact that an additional component must be positioned and assembled.

In any event, to date matchbooks have not been used to deliver more extensive and sophisticated advertising messages such as manufacturer and other types of coupons. Moreover, the design of most conventional matchbooks is not such that they can easily, economically, and effectively present to the consumer manufacturer coupons that may be neatly and easily separated for automated processing.

An object of this invention, therefore, is to provide improved methods for directly disseminating advertising messages to consumers of matches and improved matchbooks providing enhanced media for delivery of advertising messages.

It also is an object to provide such improved methods and matchbooks capable of delivering more extensive and sophisticated advertising messages, such as redeemable manufacturer and other types of coupons.

Another object of this invention is to provide improved matchbooks that are capable of delivering extensive and sophisticated advertising messages, such as redeemable manufacturer and other types of coupons, but which can be easily and economically manufactured.

It also is a more specific object of the subject invention to provide improved matchbooks, and especially matchbooks having a coupon, that may be produced by conventional machinery and processes with little or no modification.

It is a further object of this invention to provide such methods and matchbooks wherein all of the above-mentioned advantages are realized.

Those and other objects and advantages of the invention will be apparent to those skilled in the art upon reading the following detailed description and upon reference to the drawings.

SUMMARY OF THE INVENTION

The subject invention provides for novel matchbooks and methods for distributing advertising messages via matchbooks which are particularly useful in distributing more sophisticated advertising messages, especially manufacturer and other types of coupons. In particular, the subject invention provides matchbooks which have separable advertising media. The novel matchbooks comprise a comb of matches having a plurality of matches and a cover. The cover is attached to and folded over the comb such that the cover substantially encloses the comb when the cover is in a first closed position and permits a consumer to access the matches in the comb when the cover is in a second open position. The cover has igniting material on the cover on which the matches may be struck and ignited. The matchbook also has a message sheet providing a substrate on which a message may be imprinted. The message sheet is separably connected to the cover such that the message sheet is separable from the cover. Thus, the message sheet may be removed from the matchbook by a consumer without compromising the integrity of the matchbook.

Other embodiments of the novel matchbooks comprise matchbooks wherein the cover is provided on a first section of an imprintable substrate sheet and the message sheet is provided on a second section of the imprintable substrate sheet, the boundary between the first and second sections being defined by perforations in the sheet such that the second section is separable from the first section. Thus, the message sheet may be easily and neatly torn from the matchbook, but the matchbook remains fully functional.

The subject invention also provides for novel matchbooks wherein at least a portion of the message sheet is releasably affixed to a surface of the cover. Thus, the message sheet may be peeled easily and neatly from the matchbook without impairing the functionality of the matchbook.

Other preferred embodiments comprise novel matchbooks having a coupon, such as a manufacturer coupon imprinted on the message sheet, or wherein the matchbook otherwise carries a coupon. The coupon is redeemable by a consumer of the matchbook and preferably has imprinted thereon machine readable indicia to facilitate automated processing of the coupon. Preferably the machine readable indicia are a UPC bar code utilizing the UCC/EAN-128 Article Numbering System or another bar code.

It will be appreciated that the novel matchbooks may be used to efficiently and effectively distribute advertising messages, especially manufacturer and other types of coupons. Incorporating a coupon in the novel matchbooks does not appreciably increase the cost of distributing novel matchbooks beyond those costs incurred in distributing conventional matchbooks, Thus, the cost of distributing manufacturing coupons, for example, via the novel matchbooks is relatively low, the cost being essentially the incremental cost of preparing the coupon itself.

Also, because matchbooks typically are handled many times by a consumer, they can provide an effective vehicle for displaying advertising. Accordingly, the subject invention encompasses methods for distributing coupons and other advertising messages via matchbooks. The method comprises packaging matches in a container. The container is provided with a coupon which may be redeemed by a consumer. The coupon preferably includes machine readable indicia associated therewith to facilitate automated processing of the coupon. The packaged matches, including the coupon, then is distributed to a consumer outlet and finally to consumers associated with the consumer outlet. Thus, consumers receiving the matches are provided with an opportunity to view and redeem the coupon.

Preferably, the matchbooks are distributed through outlets which enhance a consumer's opportunity to view the message, such as restaurants and other food and beverage service establishments where a consumer is able to view advertising messages on the matchbook while they wait for and consume food and beverages. It is expected, therefore, that the view rates for messages distributed via the novel methods will be significantly greater than view rates for other types of direct advertising.

BRIEF DESCRIPTION OF THE DRAWINGS

FIG. 8 is a plan view of a substrate sheet 63 comprised by a novel matchbook 60, a comb of matches 21 being shown in phantom, which matchbook 60 has a separable message sheet 61 extending from the top of back panel 26 of cover 23.

FIG. 9 is a plan view of a substrate sheet 73 comprised by a novel matchbook 70, a comb of matches 21 being shown in phantom, which matchbook 70 has a separable message sheet 71 extending from the bottom of bottom panel 27 of cover 23.

DESCRIPTION OF ILLUSTRATIVE EMBODIMENTS

Figure 1:
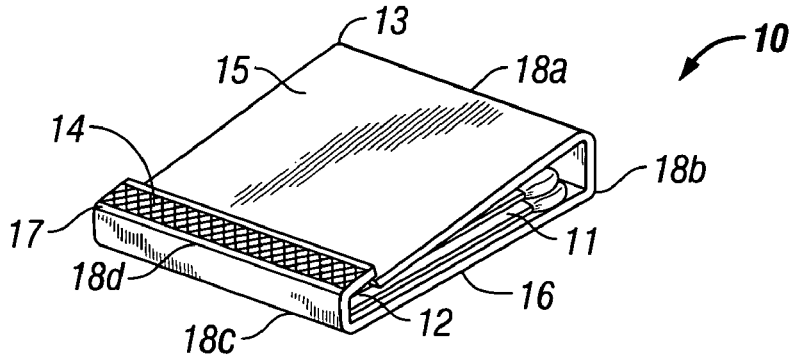
FIG. 1 (Prior Art)
FIG. 1 (prior art) is a perspective view of a conventional matchbook 10 having a top, or horizontal fold in the cover 13.

The subject invention is directed to methods for disseminating manufacturer and other types of coupons to consumers. The method comprises packaging matches in a container. The container is provided with a coupon which may be redeemed by a consumer. The coupon includes machine readable indicia associated therewith to facilitate automated processing of the coupon. The packaged matches, including the coupon, then is distributed to a consumer outlet and finally to consumers associated with the consumer outlet. Thus, consumers receiving the matches are provided with an opportunity to view and redeem the coupon.

It will be appreciated the cost of distributing manufacturer and other types of coupons via the novel methods is, in a sense, free. That is, the novel methods take advantage of the existing distribution methods for matches, especially matches that are distributed free of charge by a sponsor. Coupons may be effectively disseminated for little incremental cost over the normal costs of producing and distributing matches.

In the novel methods, packaged matches are provided with a coupon, such as a manufacturer coupon. Coupons include any offer that entitles a consumer to receive a discount on a product or service. Manufacturer coupons, as used herein, include coupons that may redeemed by a consumer at a retailer who is then reimbursed by the manufacturer of the product or sponsor of the service. Preferably the coupon includes the common features of coupons commonly in use. Such features include an offer value, such as "$1 Off", and additional offer details such as an indication of the product, package size, locations where the coupon may be redeemed, and an expiration date. It is especially preferred that the coupon incorporate machine readable indicia, such as bar codes, that will facilitate the automated processing of the coupon. Preferably the bar codes imprinted on the message section meets standards for UPC bar codes utilizing the UCC/EAN-128 Article Numbering System as are known in the industry, but other codes may be used and other information may be encoded therein. It also will be appreciated that other machine readable indicia may be provided in association with the coupon or other advertising message, such as suitably encoded magnetic media films, or such other indicia and readers and systems as may hereafter be developed or put into common use for processing coupons.

The packaged matches, with the coupon, then are distributed to consumer outlets. The consumer outlets may be any distributor of matches to consumers, including retailers who sell the matches to consumers. Preferably, however, the consumer outlet is a sponsor of the matchbooks, that is, a consumer outlet that distributes the matches to consumers free of charge in order to disseminate the sponsor's advertising message imprinted on the match container. Such sponsors traditionally have included a variety of consumer retail outlets, such as restaurants, which purchase matches having the sponsor's message custom printed on the match container, such as a box or booklet. The sponsor's advertising message is usually a relatively simple branding message.

The coupon may be directed to any product, but preferably it pertains to a product of interest to consumers of the sponsor or other outlet. For example, manufacturer coupons directed to alcohol or tobacco products may be provided on match containers distributed through restaurants, taverns, and other food and beverage service outlets. It will be appreciated that consumers in such outlets often have a greater opportunity to view advertising messages while they wait for and consume food and beverages. It is expected, therefore, that the view rates for messages distributed via the novel methods will be significantly greater than view rates for other types of direct advertising.

Preferably, the coupons are directed to a target consumer audience. For example, an advertiser may wish to limit its campaign to consumers in a specific geographical area or associated with specific types of consumer outlets. Thus, the novel methods allow for efficient and effective dissemination of manufacturer and other types of coupons to targeted consumers.

For example, the novel methods most commonly will involve the flow of information through four basic entities, (1) an agency that coordinates the flow of information from (2) a client who desires to disseminate a coupon, (3) a match manufacturer who packages matches in containers for distribution by or under the authority of (4) a perceived source or sponsor of the matches. It will be appreciated, of course, that in some situations, those entities may be the same entity, such as when a manufacturer desires to disseminate a coupon that may be included toward future purchases of matches or a sponsor who wishes to distribute a coupon for its own product or service. The perceived source of the matches may be the manufacturer, but most matches will be distributed with a sponsor, a third party who is presenting an advertising message on the match container. Any of those entities may utilize subcontractors, suppliers, and the like.

The process generally begins with coupon specifications provided to the agency by the client. Those specifications include instructions as to the content and format of the coupon to be provided with the packaged matches, the quantity of coupons to be disseminated and the time period over which the coupons will be distributed. The instructions also may include the consumers to whom the coupon will be disseminated. It will be appreciated that a particular coupon may be targeted to particular consumers by associating the coupon with matches to be distributed in a particular geographical area, through particular sponsors or consumer outlets or types of sponsors or consumer outlets, or a combination of those and other factors believed to be associated with the targeted consumers.

The message specifications of the client will be coordinated with specifications provided by the source or sponsor as to information that also will appear on the match container, such as the manufacturer's trademark or the sponsor's advertising message. In particular, if the client has specified that its message is to be disseminated through certain sponsor or types of sponsors, the client specifications will be coordinated with the specifications of the appropriate sponsors. It also will be appreciated that the coupon specifications will be coordinated, usually by the agency, with the production schedule of the manufacturer, especially where the coupon will be disseminated to targeted consumers, as the quantity of such coupons generally will be limited by expected production and sales levels for the sponsors with which the coupon will be associated.

Preferably, the client specifications are transmitted from a central computer maintained by the agency through a network, such as the Internet, dedicated, or dial-up networks, to a computer or computer system maintained by the manufacturer to control its inventory and operation of its manufacturing equipment. The manufacturer's system preferably is in communication with any subcontractor systems, such as systems maintained by a printer, so as to facilitate the preparation of the match containers and the subsequent packaging of matches. Also, once the appropriate packaging components have been imprinted in accordance with client and sponsor instructions, a code or other indicator, such as a bar code, may be assigned to components incorporating those instructions and stored in a machine readable format or medium which is printed, affixed, or otherwise associated with the components themselves or the web roll, cassettes, jigs, or packaging in which the components are handled prior to their use in the packaging process.

Matches then are packaged based on the client (or multiple client) specifications and the source or sponsor (or multiple sources or sponsors) specifications. For example, matches will be packaged in the quantities specified by the client. Preferably, once communicated to the manufacturer's computer system, the relevant client specifications, e.g., product quantity, are communicated to automated, computer controlled packaging equipment in the manufacturer's facility. The packaging equipment also are preferably provided with suitable readers for reading an indicator or code associated with the packaging components associated with a particular client and source or sponsor so that the packaging of matches proceeds in accordance with their respective instructions. The equipment may also include suitable means, such as ink jet sprayers, to apply, affix, or otherwise associate a code or other indicator, such as a bar code, associated with the client message which is in a machine readable format or medium to the match containers.

Figure 18:
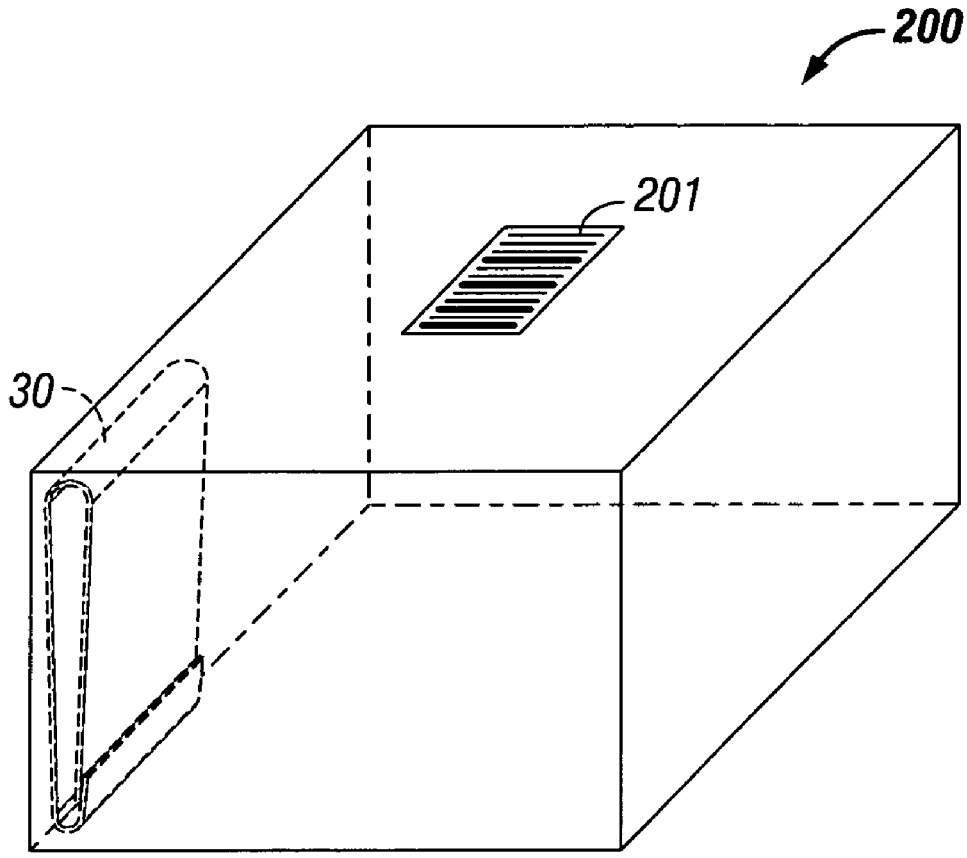
FIG. 18 is a perspective view of a shipping carton having a machine readable indicator in which packaged matches may be shipped in accordance with the subject invention.

Once the matches are packaged, the match containers with the coupon are packed and then distributed in accordance with the client specifications. For example, the client may have specified that the coupon be distributed only through particular consumer outlets, such as certain retailers or types of retailers, in certain geographic areas, or certain time periods. In particular, client specifications as to the distribution of the matches may further its purpose of reaching targeted consumers. Preferably, packaged matches are packed in a shipping carton having a machine readable indicator uniquely associated with the manufacturer coupon. For example, as illustrated in FIG. 18, packaged matches, such as a plurality novel matchbooks 30 described in further detail below and shown in further detail in FIG. 5, may be packed in a shipping carton 200 that bears a machine readable code 201. (For the sake of clarity, only a single matchbook 30 is shown in phantom in FIG. 18.) The indicator then is read and, in response to the reading, the carton containing the packaged matches is shipped to consumer outlets associated with the target consumer group or otherwise in accordance with the client's instructions. The manufacturing coupon then may be disseminated, though dissemination of the matches, to the target consumer group through the consumer outlets.

The machine readable indicator, and the apparatus for reading such indicators, may be selected from any such systems as are known in the art For example, the indicator could be a bar code readable by conventional bar code readers, such as bar code 201 on shipping carton 200 shown in FIG. 18. Alternately, the indicator could be text or numerical code that may be scanned and interpreted by conventional scan readers. The indicator also could be encoded on a microchip, magnetic strip, or other media for recording data. Other systems for storing and reading an indicator are known and may be used if desired.

Matches are packaged in a variety of packages, but most commonly in one of two general package designs. Match boxes typically have a drawer which holds individual match sticks and slides in and out of an outer cover. Matchbooks typically have a paper cover folded over a comb of matches. The novel methods of distributing manufacturer coupons encompass the use of all such conventional match containers, and they may be provided with a coupon by any suitable means. For example, a manufacturer or other type of coupon may be inserted during packaging operations into the drawer of a matchbox along with the matches. Likewise, a coupon may be inserted into booklets, preferably such that it is frictionally held by the match comb and cover. Matchbooks, such as those disclosed in the Roth '689 patent may be utilized, a coupon being imprinted on the matchbook's insert.

It will be appreciated, however, that the manufacture of such matchbooks, as compared to conventional matchbook designs, is complicated by the fact that an additional component must be positioned and assembled. Similarly, simply inserting a coupon into a match box or matchbook may complicate packaging of the matches and, in any event, creates the possibility that the coupon may become disassociated with the matches prior to their distribution to a consumer or may drop unnoticed from the matches when matches are used by the consumer. Accordingly, the subject invention also provides for novel matchbooks that are particularly suitable for distributing coupons, such as manufacturer coupons, and other advertising methods, and to methods of distributing coupons and other advertising messages using those novel matchbooks.

More particularly, the subject invention is directed to novel matchbooks having separable advertising media. The matchbooks comprise a comb of matches having a plurality of matches and a cover. The cover is attached to and folded over the comb such that the cover substantially encloses the comb when the cover is in a first closed position and permits a consumer to access the matches in the comb when the cover is in a second open position. The cover has igniting material on the cover on which the matches may be struck and ignited. The matchbook also has a message sheet providing a substrate on which a message may be imprinted. The message sheet is separably connected to the cover such that the message sheet is separable from the cover. Thus, the message sheet may be removed from the matchbook by a consumer without compromising the integrity of the matchbook.

Various embodiments of the novel invention may be viewed as improvements on conventional matchbooks. Conventional matchbooks, such as the matchbook 10 shown in FIGS. 1-2, typically comprise a comb of matches 11 in which individual matches extend and are separable from a base 12 for use by a consumer. A cover 13 is folded over the comb 11 and has igniting material 14 thereon to facilitate ignition of the matches.

Figure 2:
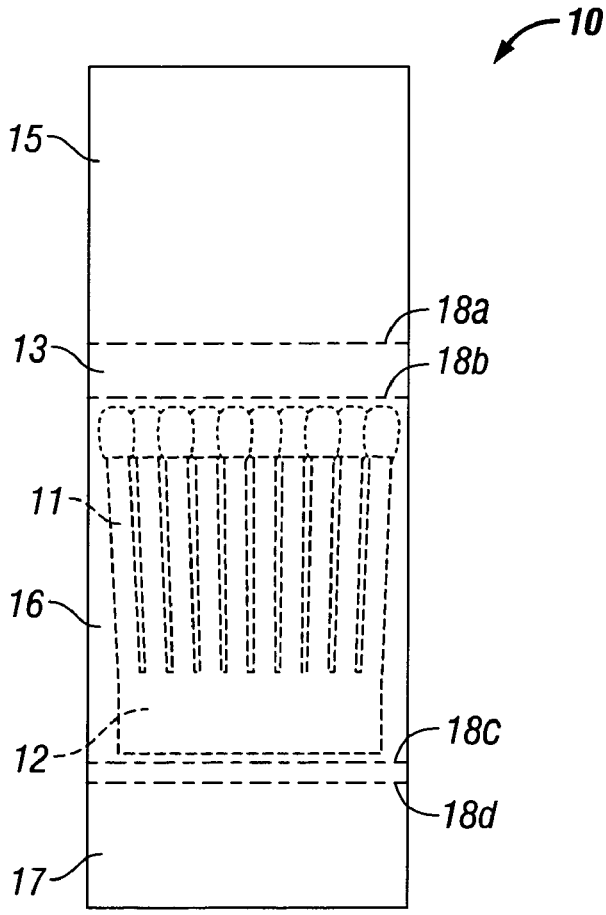
FIG. 2 (Prior Art)
FIG. 2 (prior art) is a plan view of the cover 13 of conventional matchbook 10 shown in FIG. 1, a comb of matches 11 being shown therein in phantom.

More particularly, as may be appreciated from FIG. 2, the cover 13 comprises a front panel 15, back panel 16, and bottom panel 17. Front panel 15 is separated by a pair of horizontal (as referenced to comb base 12) fold lines 18*a* and 18*b* from back panel 16, which is separated from bottom panel 17 by horizontal fold lines 18*c* and 18*d*. The cover 13 is folded along fold lines 18*c* and 18*d* such that the bottom panel 17 and back panel 16 are folded over the base 12 of comb 11. The comb base 12 is secured to the bottom panel 17 and back panel 16 typically by a staple (not shown). The front panel 15 is folded along fold lines 18*a* and 18*b* over the top of the match comb 11 such that it substantially encloses the comb 11 when the cover 13 is in a closed position (as shown). It will be appreciated that the folds described above may be made by a single fold line, if desired and practical, instead of the pair of fold lines as described. The cover 13 may be moved to an open position (not shown) in order to access the matches. It also will be appreciated that the bottom panel and front panel can be folded over the match comb along single fold lines, instead of pairs of fold lines as described above, although utilizing a pair of fold lines generally will provide a neater booklet.

Figure 3:
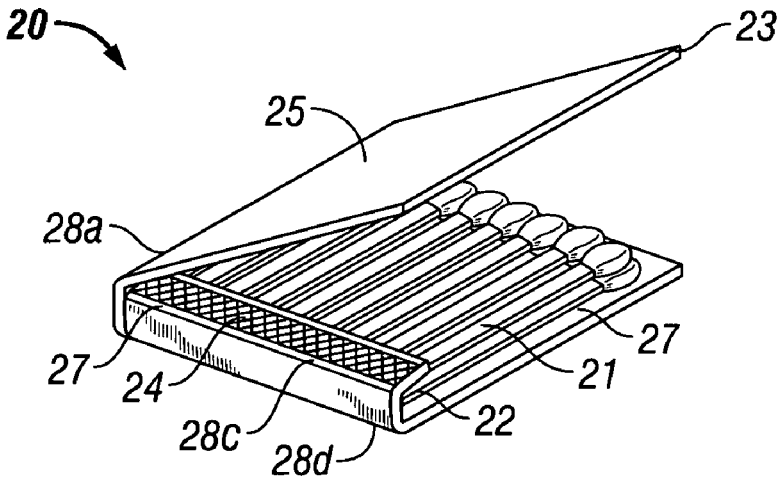
FIG. 3 (Prior Art)
FIG. 3 (prior art) is a perspective view of a conventional matchbook 20 having a side, or vertical fold in the cover 23.
Figure 4:
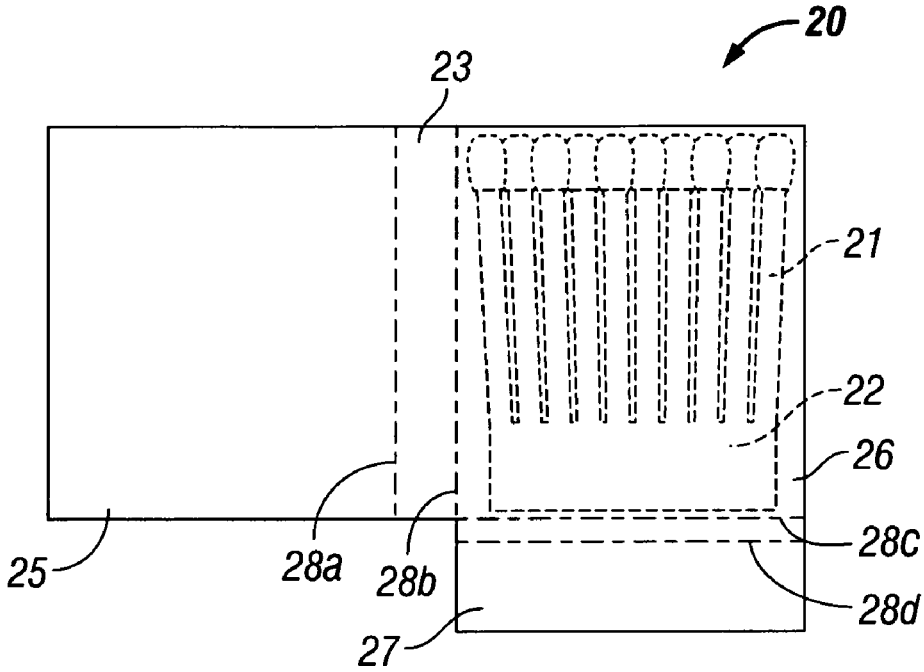
FIG. 4 (Prior Art)
FIG. 4 (prior art) is a plan view of the cover 23 of conventional matchbook 20 shown in FIG. 3, a comb of matches 21 being shown therein in phantom.

There are variations on this basic design, such as the conventional matchbook 20 shown in FIGS. 3-4. Matchbook 20 is similar to matchbook 10, except that it folds from the side, instead of the top. More specifically, matchbook 20 comprises a comb of matches 21 and a cover 23 which is folded over the comb 21 and has igniting material 24 thereon. As may be appreciated from FIG. 4, the cover 23 comprises a front panel 25, back panel 26, and bottom panel 27. Front panel 25 is separated by a pair of vertical (as referenced to comb base 22) fold lines 28*a* and 28*b* from back panel 26, which is separated from bottom panel 27 by horizontal fold lines 28*c* and 28*d*. The cover 23 is folded along fold lines 28*c* and 28*d* such that the bottom panel 27 and back panel 26 are folded over base 22 of comb 21. The comb base 22 is secured to the bottom panel 27 and back panel 26 typically by a staple (not shown). The front panel 25 is folded along fold lines 28*a* and 28*b* over the side of the match comb 21 such that it substantially encloses the comb 21 when the cover 23 is in a closed position. The cover 23 may be moved to an open position in order to access the matches. If desired, the bottom panel and front panel can be folded over the match comb along single fold lines, instead of pairs of fold lines as described above.

The novel matchbooks incorporate the basic design of such conventional matchbooks, but they also comprise a separable message sheet. For example, and in accordance with a first preferred embodiment, the subject invention provides for matchbooks having a message sheet which may be torn from the matchbook without compromising the matchbook. More specifically, such novel matchbooks comprise a comb of matches having a plurality of matches and a cover attached to and folded over the comb. The cover includes igniting material and substantially encloses the comb when the cover is in a first closed position and permits access to the comb when the cover is in a second open position. The novel matchbook also comprises a message sheet which provides a substrate on which a message may be imprinted. The cover is provided on a first section of an imprintable substrate sheet and the message sheet is provided on a second section of the imprintable substrate sheet. The boundary between the first and second sections is defined by perforations in the sheet such that the second section is separable from the first section. Thus, the message sheet may be removed from the matchbook without compromising the integrity of the matchbook.

Figure 5:
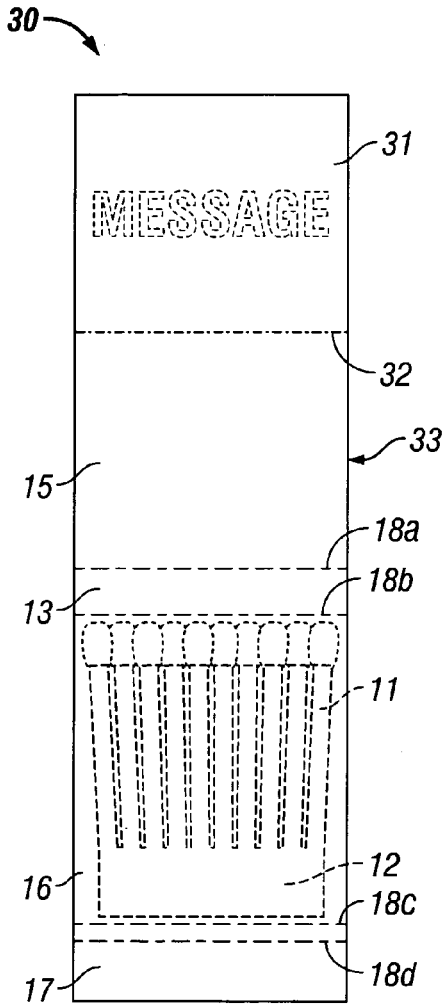
FIG. 5 is a plan view of a substrate sheet 33 comprised by a novel matchbook 30, a comb of matches 11 being shown in phantom, which matchbook 30 has a separable message sheet 31 extending from the top of front panel 15 of cover 13.
Figure 6:
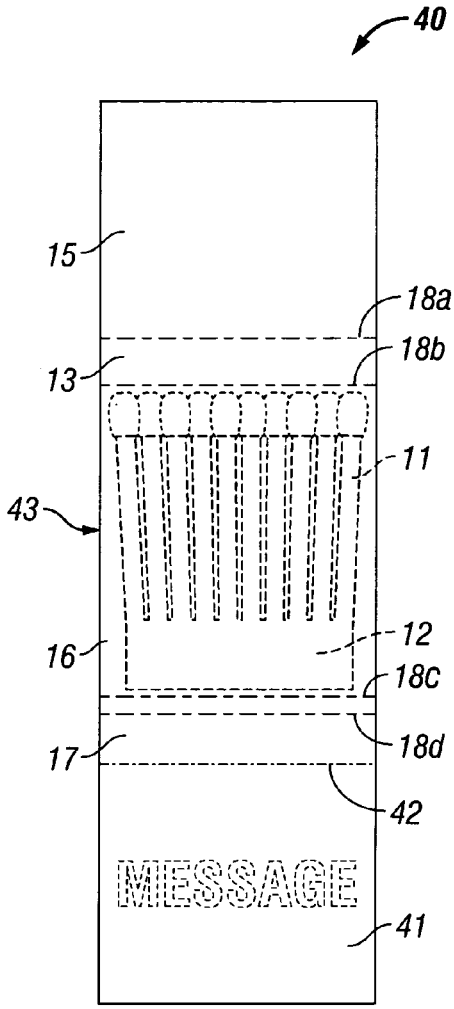
FIG. 6 is a plan view of a substrate sheet 43 comprised by a novel matchbook 40, a comb of matches 11 being shown in phantom, which matchbook 40 has a separable message sheet 41 extending from the bottom of bottom panel 17 of cover 13.
Figure 7:
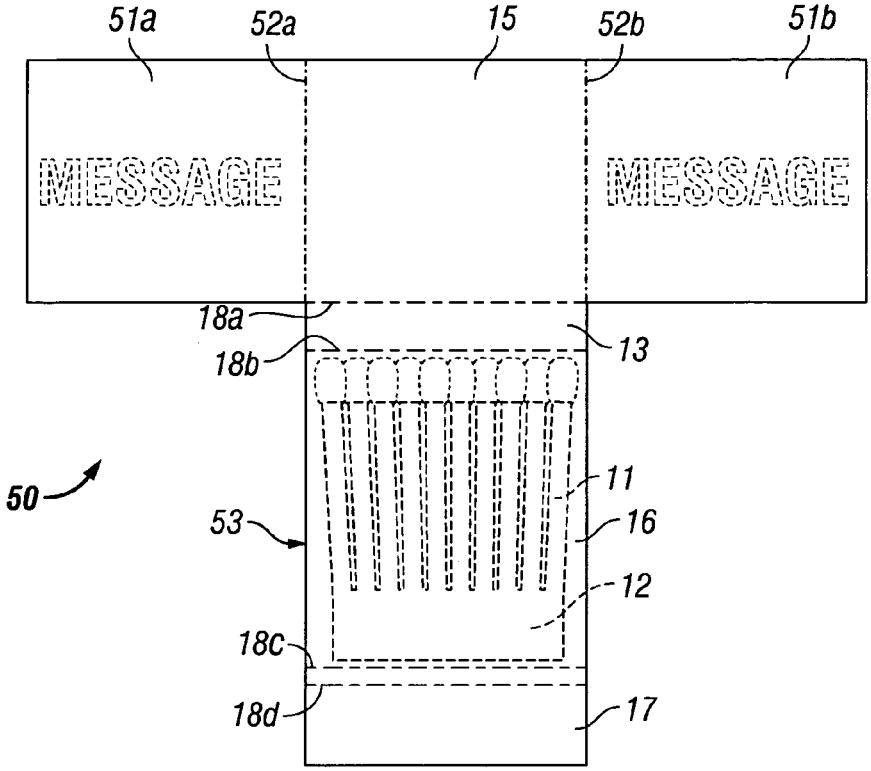
FIG. 7 is a plan view of a substrate sheet 53 comprised by a novel matchbook 50, a comb of matches 11 being shown in phantom, which matchbook 50 has two separable message sheets 51*a* and 51*b* extending from the sides of front panel 15 of cover 13.

Examples of this first preferred embodiment, matchbooks 30, 40, and 50, are shown, respectively, in FIGS. 5-7, and they may be viewed as improvements on the design of conventional matchbook 10. That is, as described above in reference to matchbook 10, they comprise a comb of matches 11 over which is folded a cover 13 having a front panel 15, back panel 16, and bottom panel 17. Cover 13 is folded along fold lines 18*c* and 18*d* such that the bottom panel 17 and back panel 16 are folded over the base 12 of comb 11. The front panel 15 is folded along fold lines 18*a* and 18*b* over the top of the match comb 11.

Matchbooks 30, 40, and 50 further comprise a message sheet which provides a substrate on which a message may be imprinted, but which may be torn from the matchbook without compromising the integrity of the matchbook. In particular, matchbook 30, as shown in FIG. 5, comprises an imprintable substrate sheet 33. The cover 13, including panels 15, 16, and 17, is provided on a first section of the substrate sheet 33. A message sheet 31 is provided on a second section of substrate sheet 33 which extends from the top (as viewed from the perspective of FIG. 5) of front panel 15. The boundary between message sheet 31 and cover 13 is defined by perforations 32 in substrate sheet 33. When matchbook 30 is assembled, message sheet 31 preferably is folded inwardly along perforations 32 against the inner face of front panel 15 where it may be viewed by a consumer upon opening matchbook 30.

As used herein perforations shall be understood to include a line of perforations extending through and along a substrate sheet such as sheet 33, as well as scoring of the sheet or any weakening thereof so that the substrate sheet may be torn along a predetermined line, thereby facilitating the removal of the message sheet without damage thereto or to the cover from which it is torn. Thus, it will be appreciated that the message sheet 31 may be easily removed from the matchbook cover 13. At the same time, matchbook 30 and, in particular, its cover 13 retains full functionality after removal of message sheet 31.

Matchbook 40, as shown in FIG. 6, comprises an imprintable substrate sheet 43. The cover 13, including panels 15, 16, and 17, is provided on a first section of the substrate sheet 43. A message sheet 41 is provided on a second section of substrate sheet 43 which extends from the bottom (as viewed from the perspective of FIG. 6) of bottom panel 17. The boundary between message sheet 41 and cover 13 is defined by perforations 42 in substrate sheet 43. When matchbook 40 is assembled, message sheet 41 preferably overlays match comb 11 where it may be viewed by a consumer upon opening matchbook 40. It also will be appreciated that the message sheet 41 may be easily removed from the matchbook cover 13 by tearing along perforations 42 without impairing the functionality of matchbook 40 and its cover 13.

Matchbook 50, as shown in FIG. 7, comprises an imprintable substrate sheet 53. The cover 13, including panels 15, 16, and 17, is provided on a first section of the substrate sheet 53. A message sheet 51*a* is provided on a second section of substrate sheet 53 which extends from one side (as viewed from the perspective of FIG. 7) of front panel 15. A second message sheet 51*b* is provided on a third section of substrate sheet 53 which extends from the other side of front panel 15. The boundaries between message sheets 51*a* and 51*b* and cover 13 are defined, respectively, by perforations 52*a* and 52*b* in the substrate sheet 53. When matchbook 50 is assembled, message sheets 51*a* and 51*b* preferably are folded inwardly along perforations 52*a* and 52*b* against the inner face of front panel 15 where they may be viewed by a consumer upon opening matchbook 50. It also will be appreciated that message sheets 51*a* and 51*b* may be easily removed from the matchbook cover 13 by tearing along perforations 52*a* and 52*b* without impairing the functionality of matchbook 50 and its cover 13.

Further examples of this first preferred embodiment, matchbooks 60, 70, 80, and 90, are shown, respectively, in FIGS. 8-11, and they may be viewed as improvements on the design of conventional matchbook 20. That is, as described above in reference to matchbook 20, they comprise a comb of matches 21 over which is folded a cover 23 having a front panel 25, back panel 26, and bottom panel 27. Cover 23 is folded along fold lines 28*c* and 28*d* such that the bottom panel 27 and back panel 26 are folded over the base 22 of comb 21. The front panel 25 is folded along fold lines 28*a* and 28*b* over the side of the match comb 21.

Novel matchbooks 60, 70, 80, and 90, like matchbooks 50, 60, and 70, further comprise a message sheet which provides a substrate on which a message may be imprinted, but which may be torn from the matchbook without compromising the integrity of the matchbook. In particular, matchbook 60, as shown in FIG. 8, comprises an imprintable substrate sheet 63. The cover 23, including panels 25, 26, and 27, is provided on a first section of the substrate sheet 63. A message sheet 61 is provided on a second section of substrate sheet 63 which extends from the top (as viewed from the perspective of FIG. 8) of back panel 26. The boundary between message sheet 61 and cover 23 is defined by perforations 62 in substrate sheet 63. When matchbook 60 is assembled, message sheet 61 preferably is folded inwardly along perforations 62 such that it overlays match comb 21 where it may be viewed by a consumer upon opening matchbook 60. Fold line 68 is provided so that the message sheet 61 will more neatly overlay match comb 21. It also will be appreciated that the message sheet 61 may be easily removed from the matchbook cover 23 by tearing along perforations 62. At the same time, matchbook 60 and, in particular, its cover 23 retains full functionality after removal of message sheet 61.

Matchbook 70, as shown in FIG. 9, comprises an imprintable substrate sheet 73. The cover 23, including panels 25, 26, and 27, is provided on a first section of the substrate sheet 73. A message sheet 71 is provided on a second section of substrate sheet 73 which extends from the bottom of bottom panel 26. The boundary between message sheet 71 and cover 23 is defined by perforations 72 in substrate sheet 73. When matchbook 70 is assembled, message sheet 71 preferably overlays match comb 21 where it may be viewed by a consumer upon opening matchbook 70. It also will be appreciated that the message sheet 71 may be easily removed from the matchbook cover 23 by tearing along perforations 72 without impairing the functionality of matchbook 70 and its cover 23.

Figure 10:
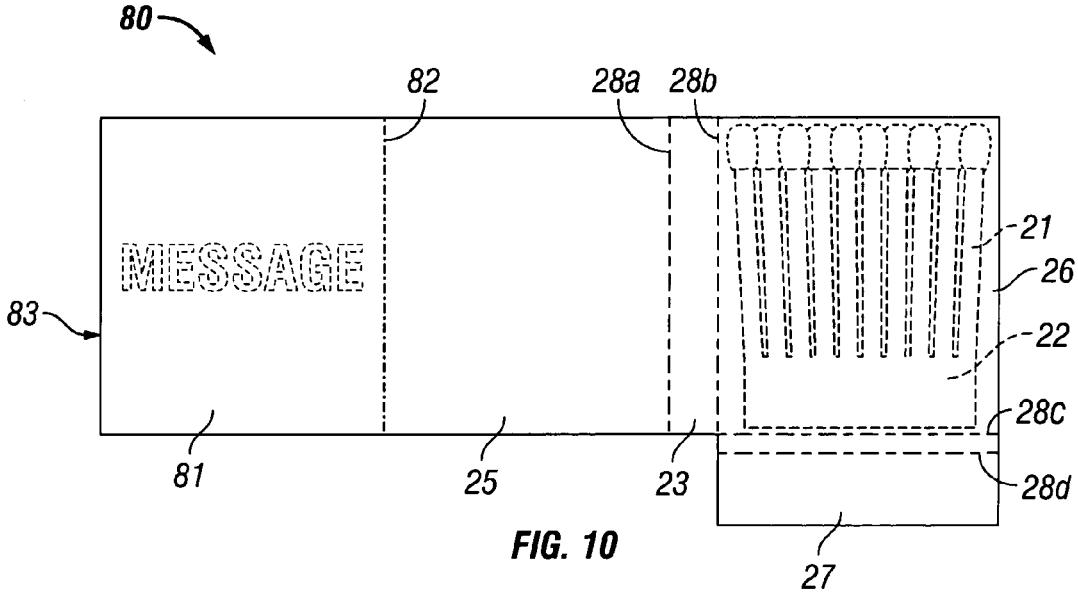
FIG. 10 is a plan view of a substrate sheet 83 comprised by a novel matchbook 80, a comb of matches 21 being shown in phantom, which matchbook 80 has a separable message sheet 81 extending from the side of front panel 25 of cover 23.

Matchbook 80, as shown in FIG. 10, comprises an imprintable substrate sheet 83. The cover 23, including panels 25, 26, and 27, is provided on a first section of the substrate sheet 83. A message sheet 81 is provided on a second section of substrate sheet 83 which extends from the side of front panel 25. The boundary between message sheet 81 and cover 23 is defined by perforations 82 in substrate sheet 83. When matchbook 80 is assembled, message sheet 81 preferably is folded inwardly along perforations 82 against the inner face of front panel 25 where it may be viewed by a consumer upon opening matchbook 80. It also will be appreciated that the message sheet 81 may be easily removed from the matchbook cover 23 by tearing along perforations 82 without impairing the functionality of matchbook 80 and its cover 23.

Figure 11:
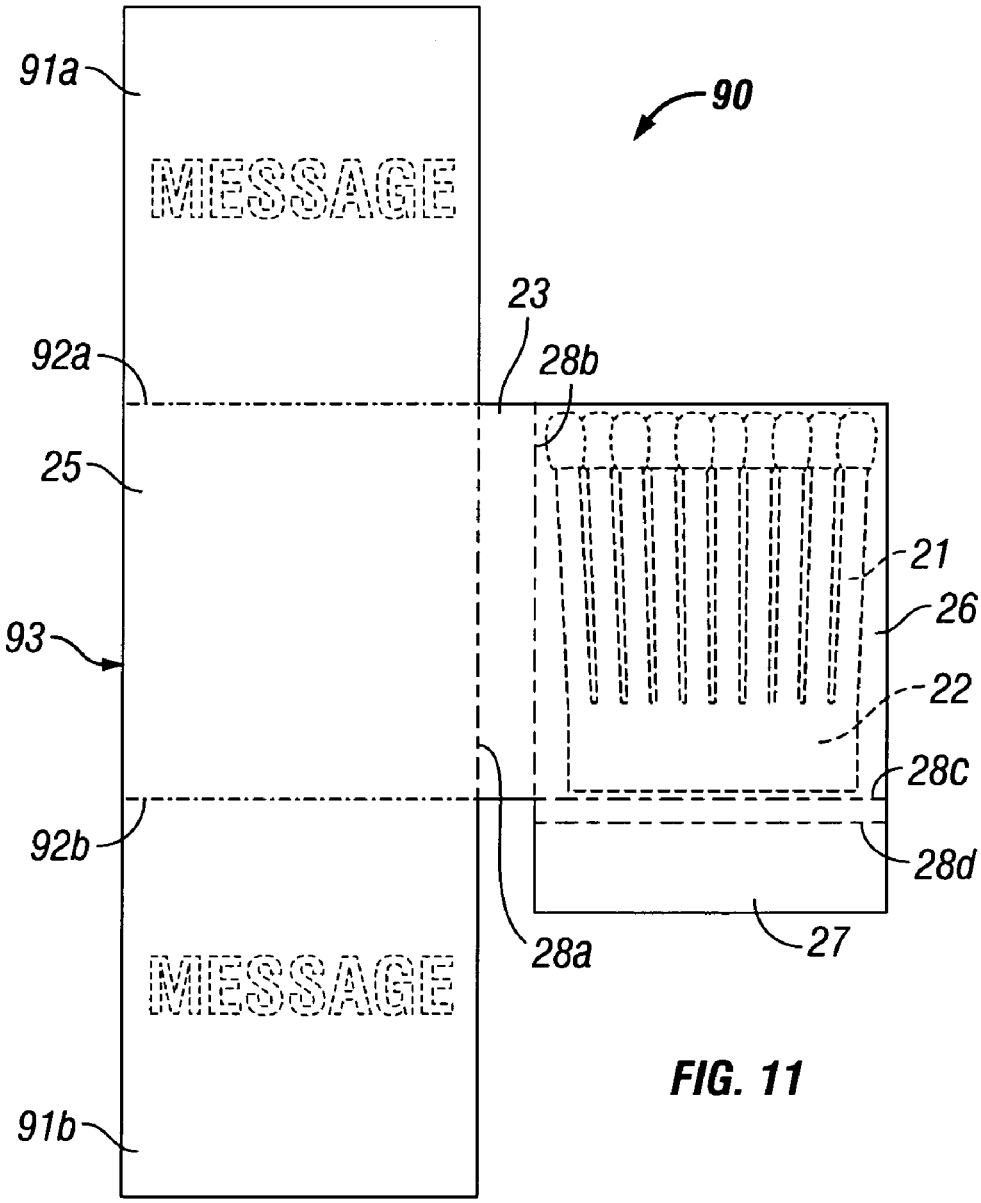
FIG. 11 is a plan view of a substrate sheet 93 comprised by a novel matchbook 90, a comb of matches 21 being shown in phantom, which matchbook 90 has two separable message sheets 91*a* and 91*b* extending, respectively, from the top and bottom of front panel 25 of cover 23.

Matchbook 90, as shown in FIG. 11, comprises an imprintable substrate sheet 93. The cover 23, including panels 25, 26, and 27, is provided on a first section of the substrate sheet 93. A message sheet 91*a* is provided on a second section of substrate sheet 93 which extends from the top of front panel 25. A second message sheet 91*b* is provided on a third section of substrate sheet 93 which extends from the bottom of front panel 25. The boundaries between message sheets 91*a* and 91*b* and cover 23 are defined, respectively, by perforations 92*a* and 92*b* in the substrate sheet 93. When matchbook 90 is assembled, message sheets 91*a* and 91*b* preferably are folded inwardly along perforations 92*a* and 92*b* against the inner face of front panel 25 where they may be viewed by a consumer upon opening matchbook 90. It also will be appreciated that message sheets 91*a* and 91*b* may be easily removed from the matchbook cover 23 by tearing along perforations 92*a* and 92*b* without impairing the functionality of matchbook 90 and its cover 23.

While this first preferred embodiment of the novel matchbooks has been exemplified by matchbooks 30, 40, 50, 60, 70, 80, and 90, which comprise message sheets provided on extensions from certain portions of the cover, it will be understood that the invention is not limited thereto. Other matchbooks may be constructed in accordance with the subject invention that comprise message sheet extensions from other portions of the cover, such as the back panel or the entire length of front and back panels. Likewise, the novel matchbooks may comprise multiple message sheet extensions extending not just from the sides of the top panel as exemplified by matchbook 50, but from any portions of the cover as desired.

Also, the message sheets may be designed so the message sheets are folded inwardly over the inner surface of the cover or extend over the match comb, as described above, so that a sponsor's advertising message on the outer surface of the cover is not obscured. If desired, however, the message sheets may be folded outwardly over the outer surface of the cover or they may be left unfolded, and such approaches may make the message sheet more visible. When folded onto the cover, the message sheets also may be tacked down, for example with a releasable adhesive, in order to provide a neater booklet.

It also will be appreciated that some of the message sheets interfere in a sense with usual functionality of the matchbooks. For example, matchbooks 40, 60, and 70 have message sheets that overlay the match comb, and other matchbooks could be similarly designed, for example, with side extensions from the back panel. Such designs require a consumer to not only fold open the front panel of the cover, but to also fold away the message sheet in order to access matches in the booklet. Thus, such designs may provide greater visibility and higher response rates for advertising messages imprinted thereon. If desired, such message sheets could be tacked down on the match comb itself, for example by a releasable adhesive, thereby requiring more consumer interaction with the message sheet.

Similarly, while the exemplified matchbooks have message sheets that are not folded upon themselves, if a larger message sheet is desired, for example, an extension may be provided with folds such that the message sheet folds in on itself, with or without tacking, as well as onto the cover. The extension also can be provided with additional lines of perforations such that a single extension provides two or more message sheets.

As a further example, and in accordance with a second preferred embodiment, the subject invention provides for matchbooks having a message sheet which may be peeled from the matchbook without compromising the matchbook. More specifically, such novel matchbooks comprise a comb of matches having a plurality of matches and a cover attached to and folded over the comb. The cover includes igniting material and substantially encloses the comb when the cover is in a first closed position and permits access to the comb when the cover is in a second open position. The novel matchbook also comprises a message sheet which provides a substrate on which a message may be imprinted. The message sheet is releasably affixed to a surface of the cover. Thus, the message sheet may be removed from the matchbook without compromising the integrity of the matchbook.

Figure 12:
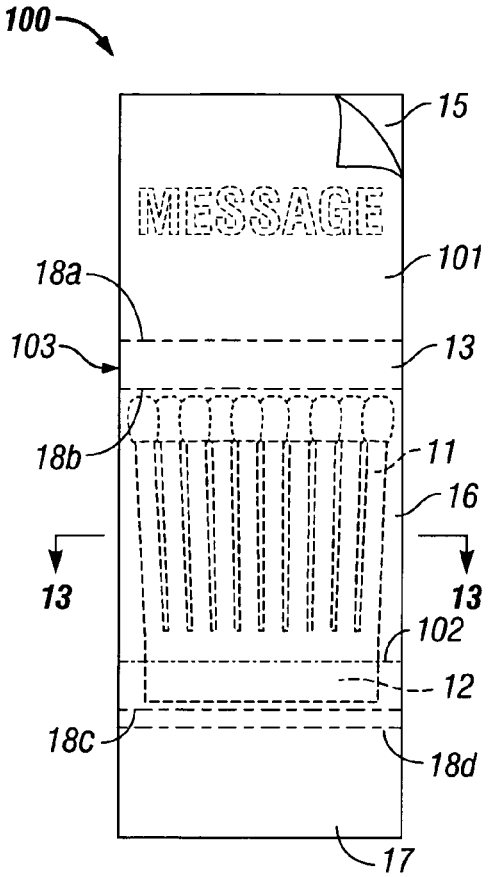
FIG. 12 is a plan view (with a partial peel-away view) of a substrate sheet 103 comprised by a novel matchbook 100, a comb of matches 11 being shown in phantom, which matchbook 100 has a separable message sheet 101 laminated to cover 13.
Figure 13:
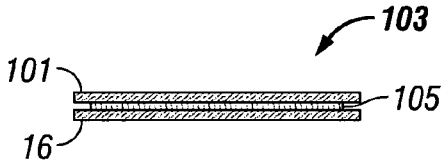
FIG. 13 is a cross-sectional view of the substrate sheet 103 shown in FIG. 12 taken along line 13-13 thereof showing the construction of substrate sheet 103.

An example of this second preferred embodiment, matchbook 100, is shown in FIGS. 12-13, and it may be viewed as an improvement on the design of conventional matchbook 10. That is, as described above in reference to matchbook 10, matchbook 100 comprises a comb of matches 11 over which is folded a cover 13 having a front panel 15, back panel 16, and bottom panel 17. Cover 13 is folded along fold lines 18*c* and 18*d* such that the bottom panel 17 and back panel 16 are folded over the base 12 of comb 11. The front panel 15 is folded along fold lines 18*a* and 18*b* over the top of the match comb 11.

Matchbook 100 further comprises a message sheet which provides a substrate on which a message may be imprinted, but which may be peeled from the matchbook without compromising the integrity of the matchbook. In particular, matchbook 100 comprises a laminate sheet 103. The laminate sheet 103 includes a first imprintable substrate layer which provides the cover 13, including panels 15, 16, and 17. The laminate sheet 103 further includes a second imprintable substrate layer releasably laminated to the inner surface of the first layer by an adhesive layer 105 and providing the message sheet 101. Message sheet 101 is provided on a section of the second layer defined by perforations 102 in the second layer. Thus, it will be appreciated that the message sheet 101 may be easily removed from the matchbook cover 13 and the rest of the second layer by peeling message sheet 101 away from cover 13 and tearing along perforations 102. Preferably at least a portion of the message sheet 101 near its edges is not adhered to the cover 13 so that it may be more easily grasped and peeled by a consumer. At the same time, matchbook 100 and, in particular, its cover 13 retains full functionality after removal of message sheet 101.

While message sheet 101 in matchbook 100 comprises a portion of second layer, other matchbooks encompassed by the subject invention may have message sheets wherein the entire second layer is a message sheet. Likewise, the second layer may comprise more than one message sheet by providing additional lines of perforations in the second layer or by providing additional layers in the laminate sheet.

Further examples of this second preferred embodiment, matchbooks 110 and 120, are shown, respectively, in FIGS. 14-15 and 16-17, and they may be viewed as improvements on the design of conventional matchbook 20. That is, as described above in reference to matchbook 20, they comprise a comb of matches 21 over which is folded a cover 23 having a front panel 25, back panel 26, and bottom panel 27. Cover 23 is folded along fold lines 28*c* and 28*d* such that the bottom panel 27 and back panel 26 are folded over the base 22 of comb 21. The front panel 25 is folded along fold lines 28*a* and 28*b* over the side of the match comb 21.

Figure 15:
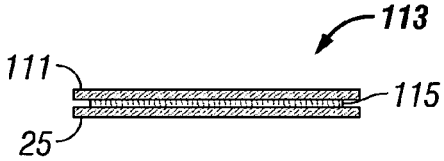
FIG. 15 is a cross-sectional view of the substrate sheet 113 shown in FIG. 14 taken along line 15-15 thereof showing the construction of substrate sheet 113.
Figure 14:
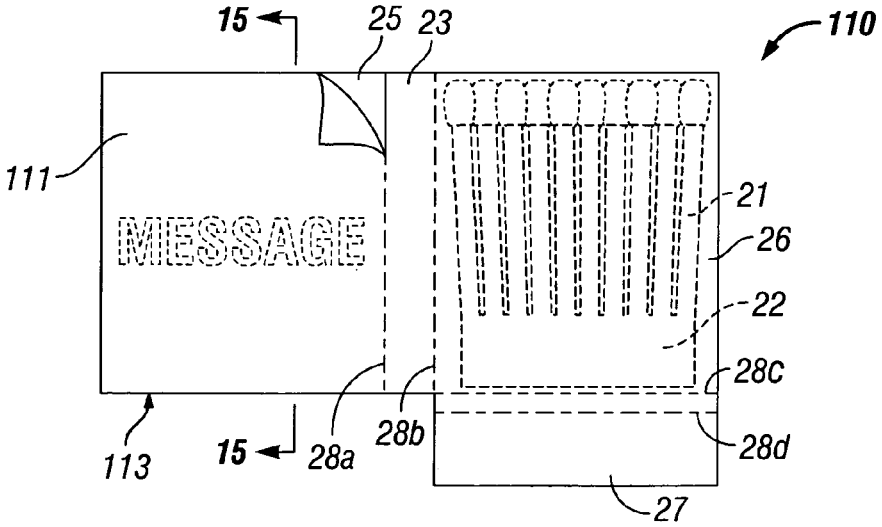
FIG. 14 is a plan view (with a partial peel-away view) of a substrate sheet 113 comprised by a novel matchbook 110, a comb of matches 21 being shown in phantom, which matchbook 110 has a separable message sheet 111 laminated to the front panel 25 of cover 23.

Novel matchbooks 110 and 120, like matchbook 100, further comprise a message sheet which provides a substrate on which a message may be imprinted, but which may be peeled from the matchbook without compromising the integrity of the matchbook. In particular, matchbook 110, as shown in FIGS. 14-15, comprises a cover 23 which includes panels 25, 26, and 27. A message sheet 111 is releasably laminated by an adhesive layer 115 to the surface of the cover 23, and more specifically, to the inner surface of front panel 25. Thus, it will be appreciated that the message sheet 111 may be easily removed from the matchbook cover 23 by peeling it away from front panel 25, and preferably at least a portion of the message sheet 111 near its edges is not adhered to the cover 23 so that it may be more easily grasped and peeled by a consumer. At the same time, matchbook 110 and, in particular, its cover 23 retains full functionality after removal of message sheet 111.

Figure 16:
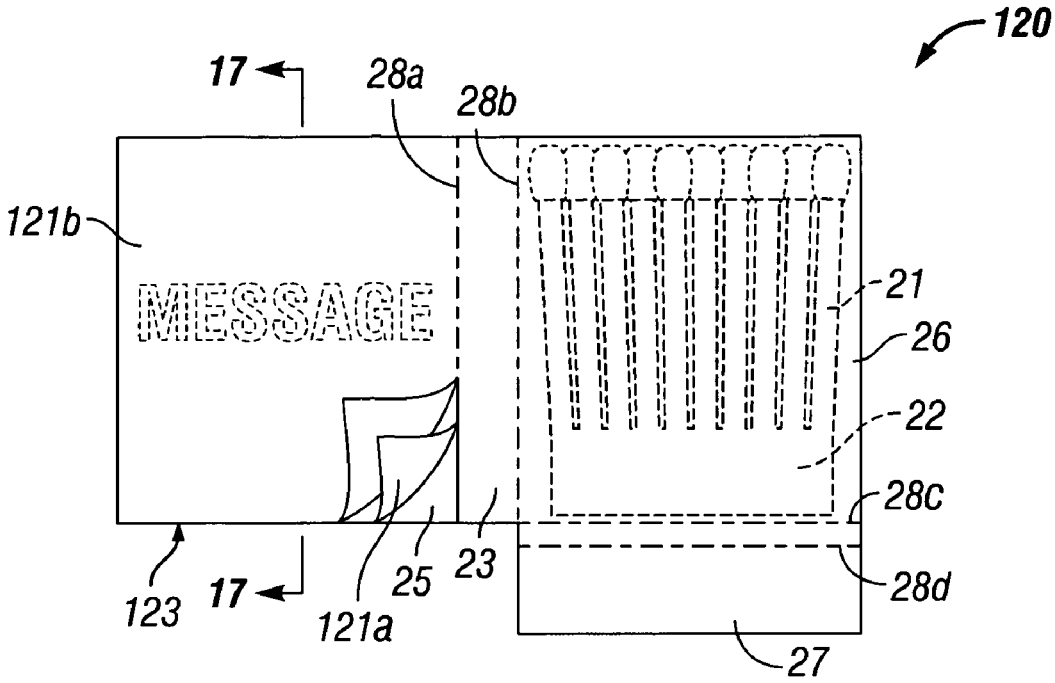
FIG. 16 is a plan view (with a partial peel-away view) of a substrate sheet 123 comprised by a novel matchbook 120, a comb of matches 21 being shown in phantom, which matchbook 120 has two separable message sheets 121*a* and 121*b* affixed to the front panel 25 of cover 23.
Figure 17:
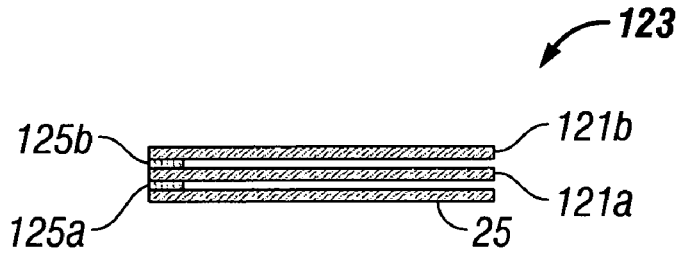
FIG. 17 is a cross-sectional view of the substrate sheet 123 shown in FIG. 16 taken along line 17-17 thereof showing the construction of substrate sheet 123.

Matchbook 120, as shown in FIGS. 16-17, comprises a cover 23 which includes panels 25, 26, and 27. Message sheets 121*a* and 121*b* are releasably affixed to the surface of cover 23. More specifically, message sheet 121*a* is releasably affixed to the surface of front panel 25, and message sheet 121*b* is releasably affixed to message sheet 121*a*. It will be noted that message sheets 121*a* and 121*b* are releasably affixed to cover 23 and to each other only at the top portions thereof, in the manner of a booklet. Thus, it will be appreciated that the message sheets 121*a* and 121*b* may be easily removed from the matchbook cover 23 by peeling them away from front panel 25 without impairing the functionality of matchbook 120 and its cover 23.

While the message sheets in matchbooks 110 and 120 are releasably affixed to the front panel 25, other matchbooks may be designed in accordance with the subject invention wherein the message sheets are releasably affixed to other portions of the cover. Also, the message sheets in the matchbooks 100, 110, and 120 are affixed to the inner surface of the cover so that a sponsor's advertising message on the outer surface of the cover is not obscured. If desired, however, the message sheets may be releasably affixed to the outer surface of the cover to make it more visible. Similarly, the illustrated embodiments all have message sheets that fully overlay the cover or a portion thereof, but portions of the message sheets may extend beyond the edges of the novel matchbook covers, and such message sheets may have greater visibility.

Also, while the illustrated embodiments comprise a message sheet that is either integral with and extends from the cover or is releasably affixed thereto, novel matchbooks may be designed that have both types of message sheets. For example, matchbook 100 could be provided with additional message sheets on extensions from the laminate sheet.

Thus, it will be appreciated that the novel matchbooks having separable message sheets may be easily and neatly removed without interfering with the functionality of the matchbooks. Thus, they are particularly suitable for providing manufacturer and other types of coupons, as the coupon may be removed before the matchbook is lost or is subject to wear and tear that may make it more difficult to automatically process the coupon. Moreover; because matchbooks are handled many times by a consumer thereof, they provide an effective vehicle for displaying the advertising.

In general, the novel matchbooks are made of materials and processes that would be used fabricating conventional matchbooks and comply with applicable regulatory standards relating to health and safety, such as laws and regulations implemented and enforced by the Consumer Product Safety Commission, and other governmental and industry organizations. It will be appreciated that the novel matchbooks, since they provide message sheets that may be readily separated and removed, provide a medium for advertising without diminishing the safety of the matchbooks in use.

More specifically, the novel matchbook covers may be fabricated from any of a variety of materials that are commonly used to fabricate the covers of conventional matchbooks. Most commonly, matchbook covers are made from papers, such as carton board, and from foil laminated paper boards. Other materials, however, may be used and include cellophane, and other synthetic or natural nonwoven fibrous substrates, monolayer, multilayer, and coextruded sheets, such as those composed of high and low density polyethylene, polypropylene, ethylene vinyl alcohol, polyester, nylon, and other polymers, and aluminum and other metallic alloys, and paper-film and other laminate substrates. Preferably the material will have tear, tensile, stiffness, and other physical characteristics that render it suitable for use in conventional processes for the automated manufacture of matchbooks.

When the novel matchbooks, such as matchbook 30, have a message section that extends from the cover and is torn therefrom along a line of perforations, the message sheet necessarily will be composed of the same material from which the cover is fabricated. In other embodiments, however, such as matchbook 100, where the message sheet is releasably affixed to the cover of the matchbook it is possible to fabricate the message sheet from different materials that may be more suited to imprinting and automated processing of the sheet as a coupon. The cover generally will have to have greater strength and durability, but such properties are not necessarily required for the message sheet and, therefore, a wider range of materials may be suitable for use as message sheets in such embodiments.

In general, where the message sheet is not integral with the cover, the message sheets in the novel matchbooks may be composed of any of a wide variety of imprintable substrates conventionally used in printed advertising materials. Such substrates include paper, such as bond and machine glazed, cellophane, and other synthetic or natural nonwoven fibrous substrates, monolayer, multilayer, and coextruded films, such as those composed of high and low density polyethylene, polypropylene, ethylene vinyl alcohol, polyester, nylon, and other polymers, and aluminum and other metallic alloys, and paper-film and other laminate substrates. Suitable films will enable the imprinting of an advertising message. They also should have tear, tensile, stiffness, memory, and other physical characteristics that render them suitable for use in automated printing and manufacturing equipment. Bond, book, and other types of paper based stock are preferred as they are relatively inexpensive, may be handled relatively easily by automated equipment, and provide an excellent substrate for conventional printing processes. Machine glazed paper is especially preferred as it will provide improved print quality. Where there are multiple message sheets, such as in matchbook 120, the message sheets may be made of the same or different materials. In general, the choice of material for the matchbook cover and message sheets will be determined by those and other factors well known to those skilled in the art of packaging, and many suitable materials are commercially available.

The subject invention provides matchbooks with imprintable message sheets which are connected to cover, but are separable therefrom without compromising the integrity of the matchbook. In certain embodiments, for example matchbook 30, a message section extends from the cover and is integral with the sheet from which the matchbook cover is made. It is removed by tearing the message section from the cover, and suitable perforations may be provided to facilitate tearing away of the message section. In other embodiments, such as matchbooks 100, 110, and 120, imprintable message sheets are releasably affixed to the lid sheet or other message sheets and are pealed therefrom. They may be releasably affixed thereto by conventional methods and materials. For example, if the material from which the cover or message sheet is fabricated is itself heat sealable, such as low density polyethylene (LDPE), the message sheet may be lightly or spot bonded to the cover. Preferably, however, either the cover or message sheet is coated or spotted in appropriate locations with a heat sealable adhesive, such as those composed of polyethylene and other thermoplastic polymers, or a pressure sensitive, peelable, low tack adhesive so that the message sheet may be removed easily and without damaging it. Any suitable method for removably connecting message sheets to the cover, however, may be used, provided that the message sheet is secured to the matchbook during shipment and distribution, but may be neatly and easily removed on the spot by a consumer of such matches.

Also, while in various preferred embodiments message sheets are described as being laminated to the cover or other message sheets by a substantially continuous layer of adhesive extending across the entire or the substantial majority of opposing faces thereof, it is not necessary, and may not even be desirable to do so. Adhesive may be applied discontinuously, e.g., in spots or lines. Also, message sheets may be affixed at only one end thereof, or where a message section is integrally formed with the cover, left free of adhesive, so as to make it readily apparent to the consumer that the message may be removed from the matchbook or simply to make the message more conspicuous. Furthermore, even where the substantial portion of the opposing faces are laminated together with a continuous or discontinuous layer of adhesive, areas near the edges of the sheets may be left free of adhesive to facilitate separation of message sheets by a consumer.

The advertising message may be imprinted by any of a number of conventional printing processes well known to workers in the art. It will be further appreciated, that in the context of the subject invention, imprinting will be understood not only to include such printing processes, but also impressing, watermarking, bonding, fusing, embossing, burning, stenciling and other processes by which indicia may be imparted to the substrate to communicate the desired advertising message. The precise method of imprinting will be coordinated with the choice of substrate, and vice versa. Printing the advertising message, however, is preferred for cost reasons and because it allows great flexibility in presenting the advertising message. Preferably the advertising messages are preprinted on a suitable web prior to packaging.

The advertising message, of course, will be determined by the advertiser. It will be appreciated, however, that when the message includes a manufacturer coupon redeemable by a consumer, it will be advisable to select substrates and imprinting methods that provide relatively high quality printing. That will improve machine readability of the bar code that as a practical matter must be associated with a manufacturer coupon. Also, while advertising messages may be preferred for most commercial purposes, the message may be in the nature of an inspirational, motivational, political message or any message that may be desired.

It also will be appreciated that the cover of the novel matchbooks, consistent with current practice, typically will also have an imprinted message on at least its exterior surface. Such messages most commonly will provide identification and information on the distributor of the matchbooks or the entity that otherwise is sponsoring the matchbooks. Thus, this sponsorship message will still be provided on the matchbook even when the message sheets have been removed. Additional messages, and especially advertising messages, may be imprinted on the message sheets. When the message is releasably affixed to the cover, it generally will be affixed to an inner surface of the cover to ensure that the sponsorship message is not obscured. The message sheets, however, may be translucent or transparent to allow consumers to view indicia printed on the matchbook cover such as a sponsorship message. Moreover, although the novel matchbooks are particularly useful in disseminating advertising messages other than those pertaining to the sponsor of the matchbook, all messages imprinted thereon may pertain to the sponsor of the matchbook.

Also, while the illustrated embodiments all have a generally rectangular shape, the subject invention is not limited thereto. Rectangular shaped matchbooks are the most common configuration, and are preferred by sponsors for their relatively low cost. Matchbooks incorporating the same basic fold-over design, however, have been manufactured in a wide variety of shapes, both regular and irregular, such as wine bottles, houses, shoes, and other products associated with the sponsor. Many more shapes may be devised. Thus, the subject invention is not limited to matchbooks having any particular shape, and the novel matchbooks may have a variety of different shapes as will be appreciated by workers in the art.

Likewise, the novel matchbooks are not limited to any particular size, but preferably are sized according to convention so that they conform to consumer expectations. Regardless, it will be appreciated that the novel matchbooks have particular utility when a relatively small matchbook is desired, as such matchbooks otherwise would have extremely limited space available for advertising messages.

As with the matchbooks, the message sheets are not limited to a particular size. For many applications it may be preferable to size the message sheets such that they, with or without additional folding, are substantially equal to the size of the cover panel or panels against which they will be folded or to which they will be adhered. The matchbook thereby may have a neater appearance, and it may also maximize the size of the message sheet for a given matchbook size and a given number of layers or folds in the matchbook. Such sizing also may be easier to accommodate in the context of conventional manufacturing processes. For other applications, however, providing an oversized message sheet, or providing a message sheet that is not completely tacked down to or folded into the cover so that the message sheet projects outward or beyond the matchbook may increase the visibility and effectiveness of the message imprinted thereon.

Moreover, it will be appreciated that the novel matchbooks have significantly greater imprintable area, yet they do not necessarily occupy significantly more space than comparable conventional matchbooks. Even when multiple message sheets or folded message sheets are incorporated into the matchbook, the matchbook is not necessarily significantly thicker than conventional matchbook covers and the overall size of the matchbook is virtually unchanged. This can be a significant advantage as a manufacturer may be able to package and ship the novel matchbooks in the same containers as are used for its standard sizes of conventional matchbooks. The novel matchbooks may be sized according to such conventions, yet still provide significantly larger areas for imprinting messages, an advantage that as noted is greater as the size of the matchbook is diminished.

For example, approximate common dimensions for matchbooks such as matchbook 10 are as follows: cover (overall)—1.5"×4.25"; front panel—1.5"×1.5"; back panel—1.5"×1.875"; bottom panel 1.5"×. 0.5". If those dimensions are utilized in matchbooks such as 30, the message section may be the same size as the front panel, providing 2.25 $in^2$ of imprintable area on each face there. That is more than adequate for providing relatively sophisticated advertising messages, such as manufacturer coupons, but it will still fold neatly into the matchbook without significantly increasing its overall size. It will be appreciated that other configurations for the novel matchbooks provide similar benefits.

It also will be appreciated that the novel matchbooks may be produced by making relatively minor modifications to conventional processes and machinery for making matchbooks. As is well known in the art, such machinery includes various cutters and folders for forming matchbook covers from a continuous web of cover material and for securing a match comb therein, usually by stapling.

The methods of the subject invention are directed to disseminating advertising messages to consumers which include, but are not limited to manufacturer and other types of coupons. Such novel methods comprise packaging matches in a matchbook having an advertising message which may be viewed by a consumer of said matches, the matchbooks being one of the novel matchbooks. That is, the matchbooks are selected from the group consisting of the novel matchbooks described herein or any subgroup thereof. The matchbooks with the advertising message is distributed to a consumer outlet and then distributed to consumers associated with the consumer outlet. The advertising message is thereby distributed to consumers of the matchbooks.

While this invention has been disclosed and discussed primarily in terms of specific embodiments thereof, it is not intended to be limited thereto. Other modifications and embodiments will be apparent to the worker in the art.

What is claimed is:

1. A method for providing product advertising messages for dissemination to a target consumer group, which method comprises:

(a) packaging matches in a container having a branding advertising message from a sponsor and a separable manufacturer coupon from a client, said match containers comprising i) a first substrate on which said branding message is imprinted; and ii) a message sheet providing a second substrate on which said manufacturer coupon is imprinted;

iii) wherein said manufacturer coupon is redeemable by a consumer of said matchbook and includes machine readable code associated therewith to facilitate automated processing of said coupon; and iv) wherein said message sheet is separably connected to said match container such that said manufacturer coupon may be separated from said match container and removed from said match container by a consumer without compromising the integrity of said match container or said first substrate on which said sponsor branding message is imprinted;

(b) distributing said match containers to a consumer outlet associated with said target consumer group so that said matchbooks with said manufacturer coupon may be distributed to consumers associated with said consumer outlet and thereby disseminate said manufacturer coupon to said target consumer group.

2. The method of claim 1, wherein said match containers are matchbooks comprising:

(a) a comb of matches having a plurality of matches, (b) a cover attached to and folded over said comb, said cover substantially enclosing said comb when said cover is in a first closed position and permitting access to said comb when said cover is in a second open position, said cover providing said first substrate on which said branding message is imprinted;

(c) igniting material on said cover; and (d) wherein said message sheet is separably connected to said cover such that said manufacturer coupon may be separated from said cover and removed from said matchbook by a consumer without impairing the ability of said cover to substantially enclose said comb when said cover is in said first closed position.

3. The method of claim 1, wherein said manufacturer coupon includes a bar code associated therewith.

4. The method of claim 3, wherein said manufacturer coupon includes a UPC bar code utilizing the UCC/EAN-128 Article Numbering System.

5. The method of claim 1, wherein said consumer outlet is a food service establishment.

6. The method of claim 1, wherein said consumer outlet is the sponsor of said matches and said branding message pertains to said consumer outlet.

7. The method of claim 1, wherein said manufacturer coupon is directed to alcoholic beverages or tobacco products.

8. The method of claim 1, wherein said branding advertising message is for a food service outlet and said manufacturer coupon is for alcoholic beverages or tobacco products.

9. The method of claim 2, wherein said matchbook cover is provided on a first section of an imprintable substrate sheet and said message sheet is provided on a second section of said imprintable substrate sheet, the boundary between said first and second sections being defined by perforations in said sheet such that said second section is separable from said first section whereby said message sheet may be removed from said matchbook.

10. The method of claim 9, wherein:

(a) said comb has a base from which said plurality of matches extend;

(b) said cover has i) a back panel and a bottom panel separated by at least one horizontal fold line extending therebetween, wherein said back and bottom panels are folded over said comb base and said comb base is attached to said back and bottom cover panels, and ii) a front panel separated from said back panel by at least one fold line extending therebetween;

iii) said cover substantially enclosing said comb when said front panel is in a first closed position and permitting access to said comb when said front panel is in a second open position;

(c) said message sheet extends from said back panel or said front panel and is separable therefrom by said perforations.

11. The method of claim 2, wherein at least a portion of said message sheet is releasably affixed to a surface of said cover.

12. The method of claim 11, wherein:

(a) said match comb has a base from which said plurality of matches extend;

(b) said cover has i) a back panel and a bottom panel separated by at least one horizontal fold line extending therebetween, wherein said back and bottom panels are folded over said comb base and said comb base is attached to said back and bottom cover panels, and ii) a front panel separated from said back panel by at least one fold line extending therebetween;

iii) said cover substantially enclosing said comb when said front panel is in a first closed position and permitting access to said comb when said front panel is in a second open position;

(c) said message sheet is releasably affixed to said back panel or said front panel.

13. The method of claim 2, wherein said matchbook comprises a laminate sheet comprising a first layer, said first layer providing said cover and said first substrate on which said branding message is imprinted, and a second layer releasably laminated to said first layer, said second layer providing said message sheet and said second substrate on which said manufacturer coupon is imprinted.

14. The method of claim 2, wherein said branding advertising message pertains to a food service outlet and said manufacturer coupon is for alcoholic beverages or tobacco products.

15. The method of claim 9, wherein said branding advertising message pertains to a food service outlet and said manufacturer coupon is for alcoholic beverages or tobacco products.

16. The method of claim 10, wherein said branding advertising message pertains to a food service outlet and said manufacturer coupon is for alcoholic beverages or tobacco products.

17. The method of claim 11, wherein said branding advertising message pertains to a food service outlet and said manufacturer coupon is for alcoholic beverages or tobacco products.

18. The method of claim 12, wherein said branding advertising message pertains to a food service outlet and said manufacturer coupon is for alcoholic beverages or tobacco products.

19. The method of claim 13, wherein said branding advertising message pertains to a food service outlet and said manufacturer coupon is for alcoholic beverages or tobacco products.

20. The method of claim 2, wherein said manufacturer coupon includes a bar code associated therewith.

21. The method of claim 7, wherein said manufacturer coupon includes a bar code associated therewith.

22. The method of claim 9, wherein said manufacturer coupon includes a bar code associated therewith.

23. The method of claim 11, wherein said manufacturer coupon includes a bar code associated therewith.

24. The method of claim 14, wherein said manufacturer coupon includes a bar code associated therewith.

25. The method of claim 15, wherein said manufacturer coupon includes a bar code associated therewith.

26. The method of claim 16, wherein said manufacturer coupon includes a bar code associated therewith.

27. The method of claim 17, wherein said manufacturer coupon includes a bar code associated therewith.

28. The method of claim 18, wherein said manufacturer coupon includes a bar code associated therewith.

29. The method of claim 19, wherein said manufacturer coupon includes a bar code associated therewith.

* * * * *